US006165024A

United States Patent [19]

Ko

[11] Patent Number: 6,165,024

[45] Date of Patent: Dec. 26, 2000

[54] ARRANGEMENT FOR PREVENTING MISMATCHING OF CONNECTOR ASSEMBLY

[75] Inventor: David Tso-Chin Ko, Thousands Oaks, Calif.

[73] Assignee: Hon Hai Precision Ind. Co, Ltd., Taipei Hsien, Taiwan

[21] Appl. No.: 09/152,037

[22] Filed: Sep. 11, 1998

[51] Int. Cl.[7] ..... H01R 13/64

[52] U.S. Cl. ..... 439/680

[58] Field of Search ..... 439/677, 680, 439/681, 675–676, 678, 679, 878

[56] References Cited

U.S. PATENT DOCUMENTS

| | | | |
|---|---|---|---|
| 4,345,813 | 8/1982 | Hatch | 439/681 |
| 4,867,699 | 9/1989 | Oda et al. | 439/680 |
| 5,342,221 | 8/1994 | Peterson | 439/677 |
| 5,915,996 | 6/1999 | Kitamura | 439/680 |

*Primary Examiner*—Paula Bradley
*Assistant Examiner*—Antoine Ngandjui

[57] ABSTRACT

An electrical connector assembly (10) includes a female connector (12) and more than one male connectors (30) wherein the female connector (12) includes a first insulative housing (14) defining a plurality of cavities (16) for receiving a corresponding number of first contacts therein, respectively, and each of the male connectors (30) includes a second insulative housing (32) forming a plurality of sleeve members (34) thereof for accommodating a corresponding number of second contacts therein. The cavities (16) of the female connector (12) can receive the sleeve members (34) of the respective selected male connector (30) by means that a pair of keys (36) are formed on the two sleeve members (34) located at two opposite ends of the second housing (32) of each selected male connector (30), and a pair of fixed keyways (18) are respectively formed, adjacent to two cavities (16) at two opposite ends in the first housing (14) of the female connector (12), and at least one additional variable keyway (18) is formed, adjacent to one cavity (16), in the first housing (14) of the female connector (12) wherein such additional keyway (18) is positioned between such pair of fixed keyways (18). Therefore, the female connector (12) is adapted to receive not only one specific male connector (12) having the same number of sleeve members thereof corresponding to the cavities (16) of the female connector (12), but also at least one additional selective male connector (30) different from such specific male connector (30).

14 Claims, 8 Drawing Sheets

51

ARRANGEMENT FOR PREVENTING MISMATCHING OF CONNECTOR ASSEMBLY

BACKGROUND OF THE INVENTION

1. Field of the Invention

The invention relates to electrical connector assemblies, and particularly to an arrangement or a system for preventing incorrect matching of a male connector with a complementary female connector which is designed not to accept such male connector.

2. The Related Art

The copending application Ser. No. 09/075,508 filed May 8, 1998 now U.S. Pat. No. 6,022,246, discloses a systematic arrangement of connector assemblies which prevents mismating between the male connectors and the female connectors. Anyhow, in that design only the male connectors and the female connectors having the same contact numbers with each other, could be matched together.

Recently, in some applications, it is desired to allow two or more different male connectors having different contact numbers to be adapted to be mutually exclusively coupled to one female connector for flexible application consideration. Thus, the previous design can not meet the requirements of this alternative situation, and should be reconfigured to be a new systematic arrangement to comply with the criterion of this new alternative situation.

Therefore, an object of the invention is to provide an understandable systematic and scientific way which is easy to follow for accomplishment of accurate matching between the male connectors and the female connectors wherein more than one male connectors are selected to be designedly mated with one female connector.

SUMMARY OF THE INVENTION

According to an aspect of the invention, an electrical connector assembly includes a female connector and more than one male connectors wherein the female connector includes a first insulative housing defining a plurality of cavities for receiving a corresponding number of first contacts therein, respectively, and each of the male connectors includes a second insulative housing forming a plurality of sleeve members thereof for accommodating a corresponding number of second contacts therein. The cavities of the female connector can receive the sleeve members of the respective selected male connector by means that a pair of keys are formed on the two sleeve members located at two opposite ends of the second housing of each selected male connector, and a pair of fixed keyways are respectively formed, adjacent to two cavities at two opposite ends in the first housing of the female connector, and at least one additional variable keyway is formed, adjacent to one cavity, in the first housing of the female connector wherein such additional keyway is positioned between such pair of fixed keyways. Therefore, the female connector is adapted to receive not only one specific male connector having the same number of sleeve members thereof corresponding to the cavities of the female connector, but also at least one additional selective male connector different from such specific male connector.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
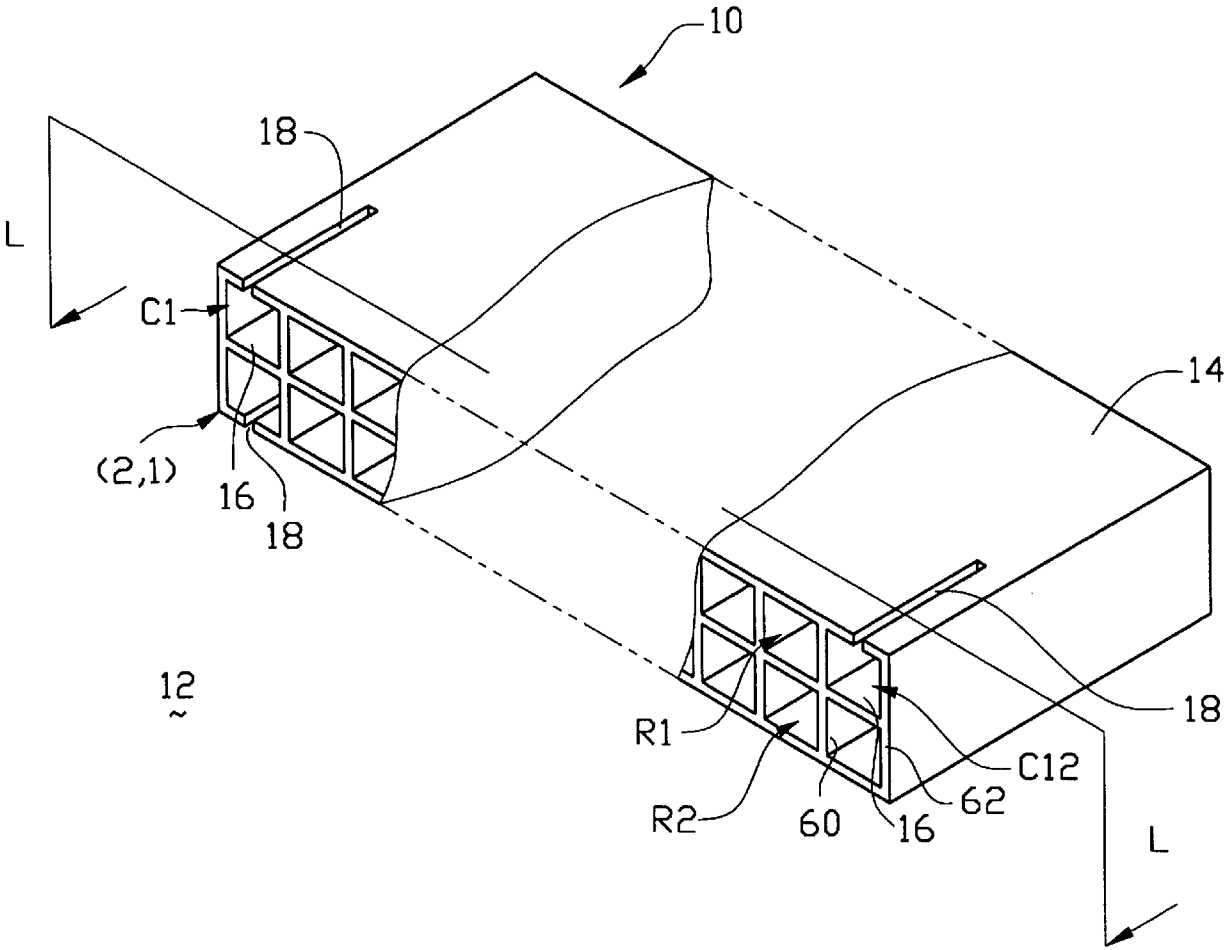
FIG. 1 is a perspective view of a presently preferred embodiment of a female connector of an electrical connector assembly, according to the invention, wherein the additional variable keyway has not been set in the housing.
Figure 2:
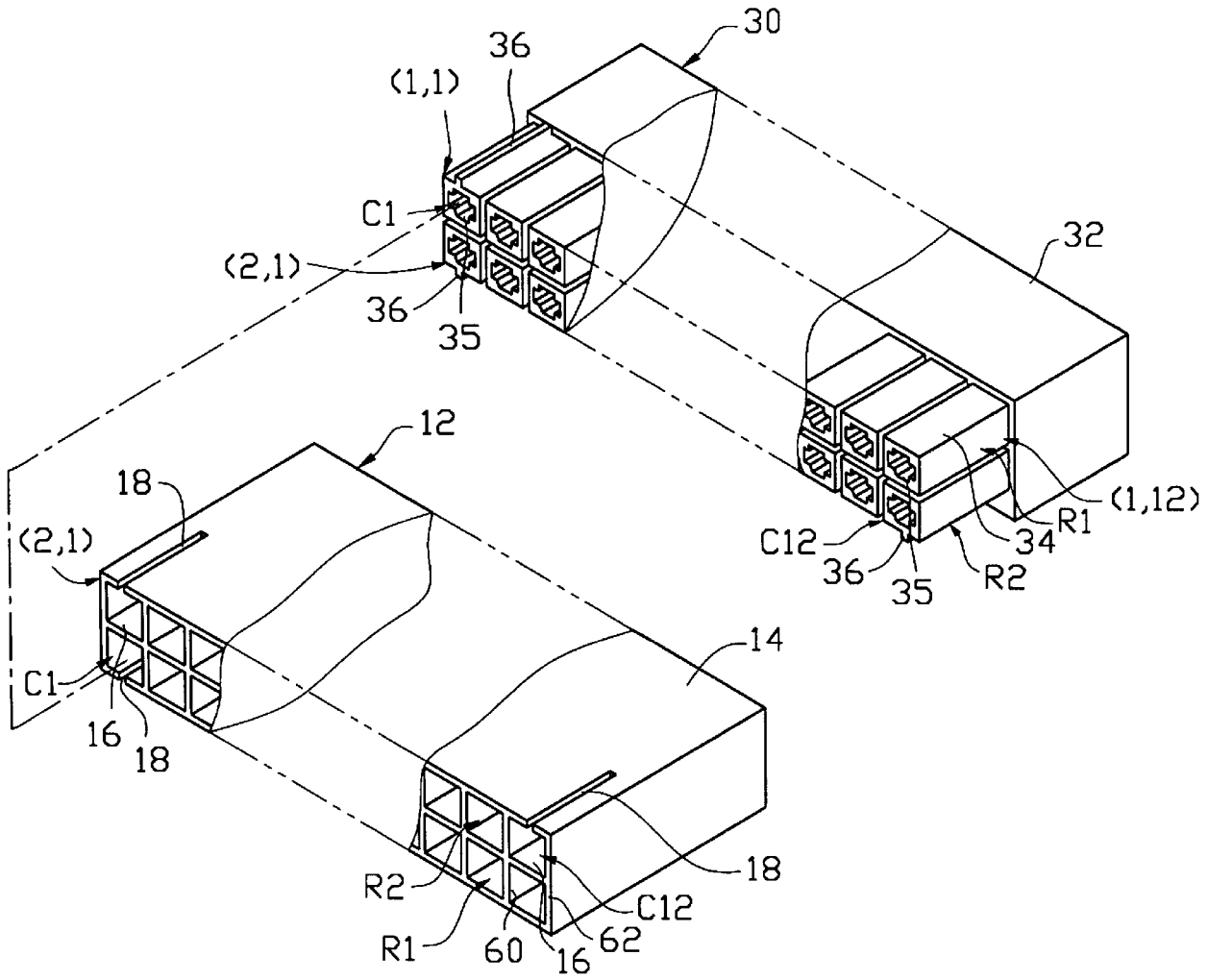
FIG. 2 is a perspective view of a presently preferred embodiment of one male connector of the connector assembly of FIG. 1, which has the same contact number with the female connector of FIG. 1 and is adapted to be mated with the female connector of FIG. 1.
Figure 3:
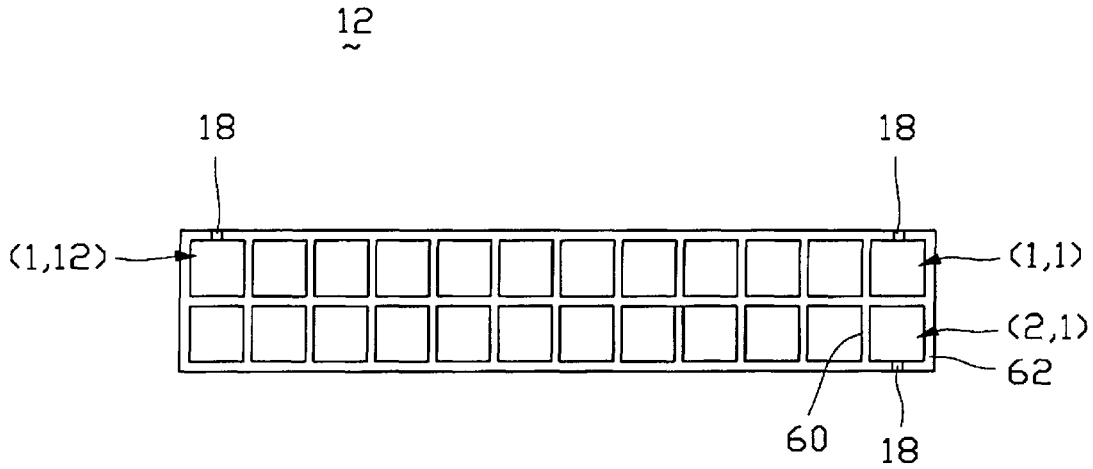
FIG. 3 is a plan view of the female connector of FIG. 1.

It will be noted here that for a better understanding, most of like components are designated by like, reference numerals throughout the various figures in the embodiments. Attention is directed to FIGS. 1–3 wherein an electrical connector assembly 10 includes a (2×12) female connector 12 comprising an insulative housing 14 which defines two rows of cavities 16 for receiving a number of plug contacts (not shown) therein.

A pair of fixed keyways 18 are formed at two opposite ends of the housing 14 respectively adjacent to the cavities 16 of the first row, and also of the first column and of the last column. A third fixed keyway 18 is formed in the housing 14 adjacent to the cavity 16 of the last row and the first column. In this embodiment, there are twelve columns and two rows. In other words, the female connector 10 is of a 2×12 arrangement. Thus, the first column is Column 1 labeled as C1, and the last Column is Column 12 labeled as C12. Similarly, two rows are respectively represented by R1 and R2. Accordingly, each cavity 16 can be represented as (R,C) wherein R is 1 or 2 and C is an integer within the range from 1 to 12.

Correspondingly, as shown in FIG. 2, one (2×12) male connector 30 includes an insulative housing 32 forming two rows of sleeve members 34 extending forward, and each sleeve member 34 defines a passageway 35 for receiving a corresponding socket contact (not shown) therein. The male connector 30 shown in FIG. 2 is of a 2×12 arrangement. Similar to the female connector 12, each sleeve member 34 can be represented as (R,C) wherein R is 1 or 2 and C is an integer within the range from 1 to 12. Corresponding to the female connector 12, the sleeve members 34 labeled (1,1), (1,12) and (2,1) respectively include keys 36 for respective reception within the corresponding keyways 18 when the female connector 12 and the male connector 30 are mated with each other. This matching arrangement mainly follows the principle described in the aforementioned copending application Ser. No. 09/075,508.

Different from the previous copending application which intends to couple two female and male connectors together having exactly the same number/manner of the sleeve members and of the cavities, the object of the invention is to achieve a female connector may be alternatively coupled to other selected male connectors each having a less number of sleeve members relative to the number of the cavities of the female connector.

To meet this requirement, the female connector 12 in this application includes two mainly different things in comparison with that in the previous copending application. First, keyway 18 and key 36 are additionally respectively adjacent to cavity 16 labeled (2,1) of the female connector 12, and adjacent to sleeve member 34 labeled (2,1) of the male connector 30, the function of which will be illustrated later. Secondly, at least one additional keyway 18 may be variably formed in the housing 14 adjacent to at least one specific cavity 16 labeled as (R,C) wherein R is 1 and C is an integer within the range between 2 and 11.

It is appreciated that the male connector 30 shown in FIG. 2 represents the general configuration of the variable ones. It means that regardless of whether the male connector is a 2×12, 2×10 or even 2×5, etc., the three fixed keys 36 are always respectively formed on sleeve members 16 of row 1 and column 1, of row 2 and column 1, and of row 1 and the last column wherein the last one fixed key is labeled by a variant index determined by the different male connectors 30 having different numbers of sleeve members.

Figure 4A:
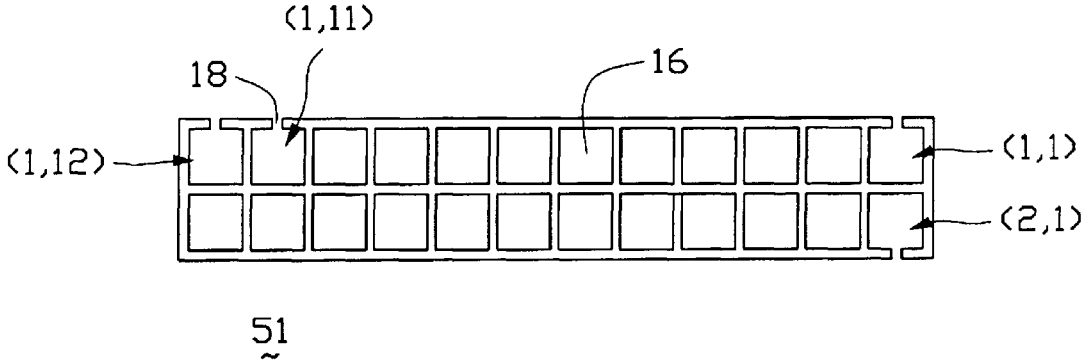
FIGS. 4(A)–4(J) are plan views each generally taken from a cross-section along line L—L of the female connector of FIG. 1 and each having one additional variable keyway between two fixed keyways at two opposite ends to show the different combinations of the mating arrangement.
Figure 4B:
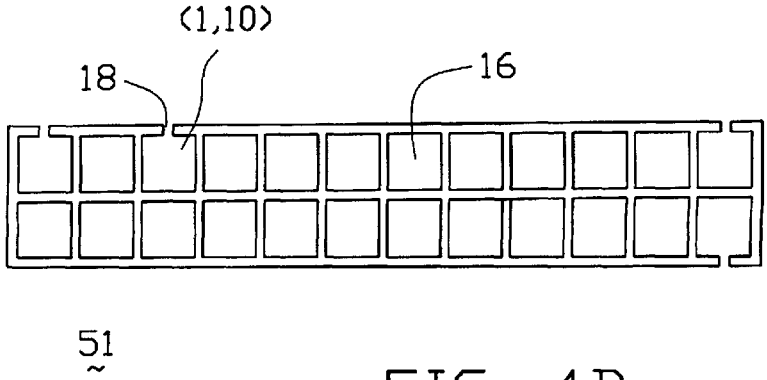
Figure 4C:
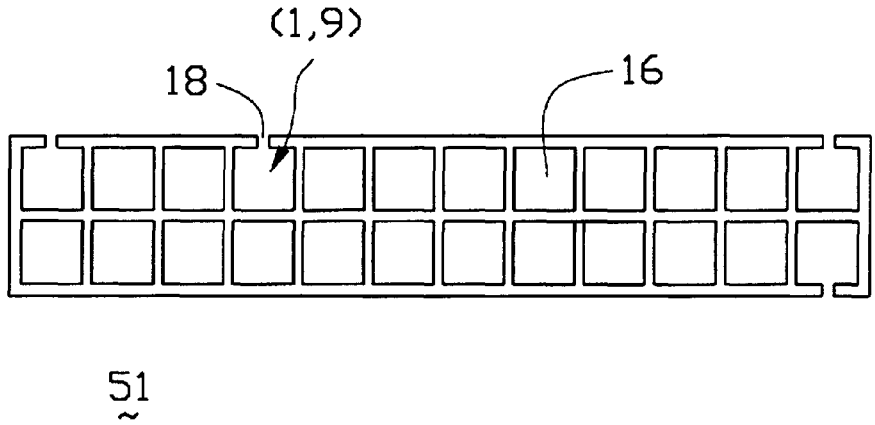
Figure 4D:
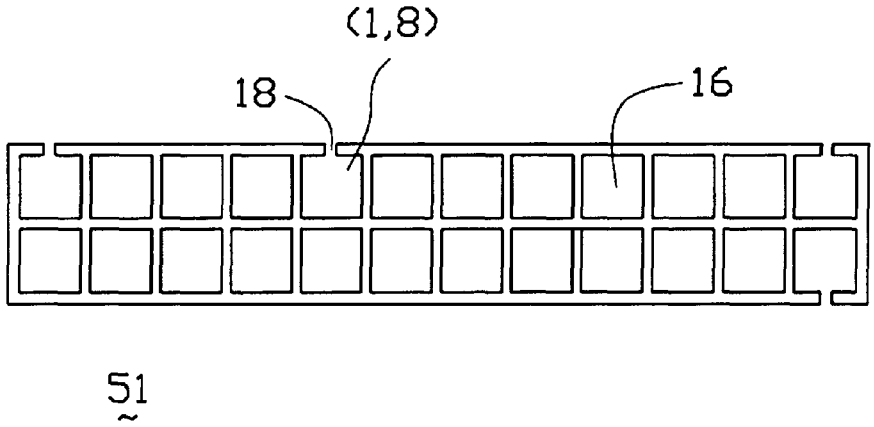
Figure 4E:
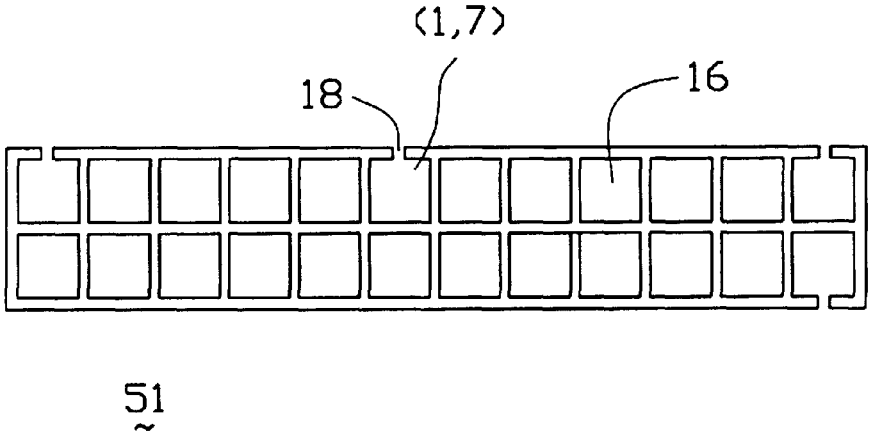
Figure 4F:
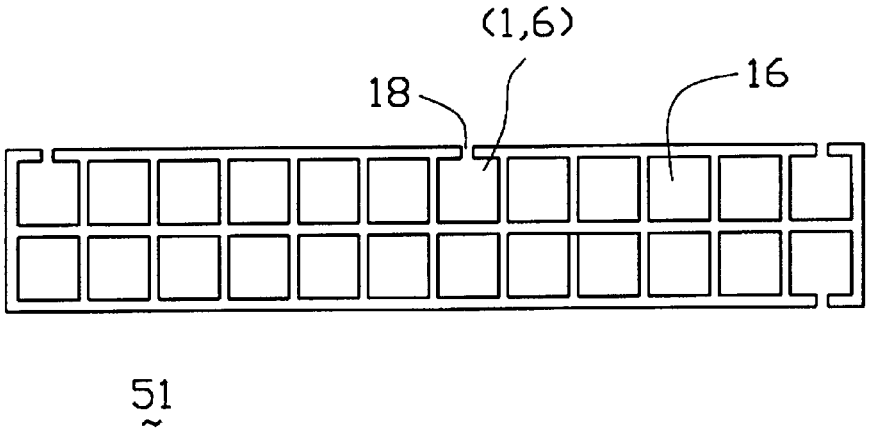
Figure 4G:
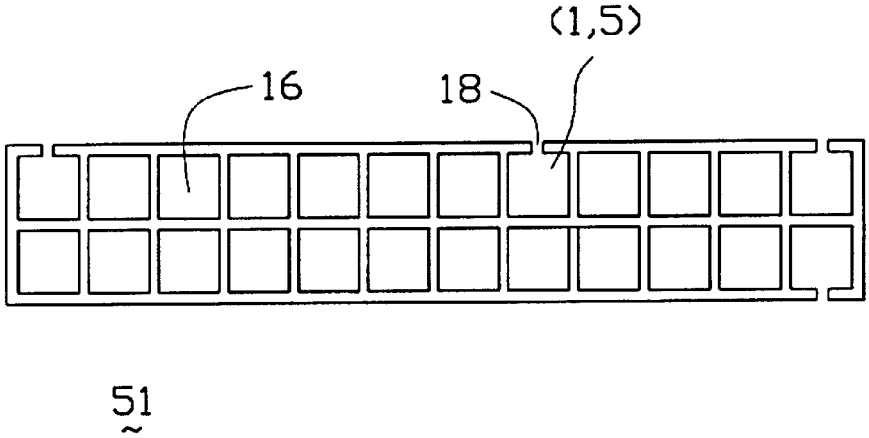
Figure 4H:
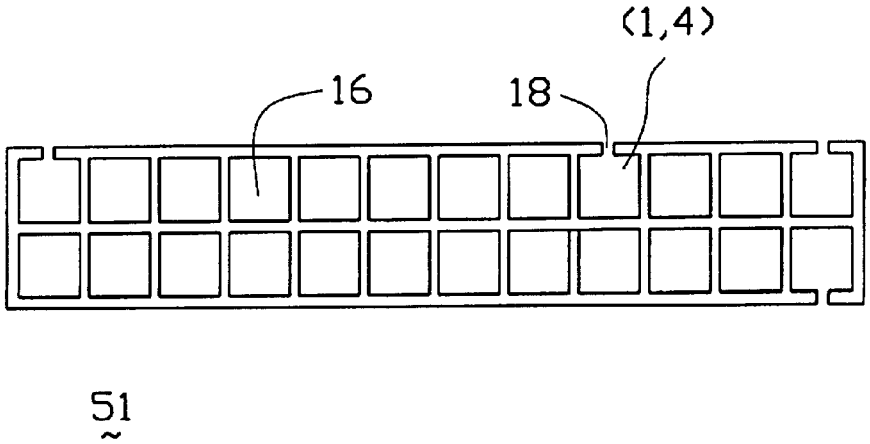
Figure 4I:
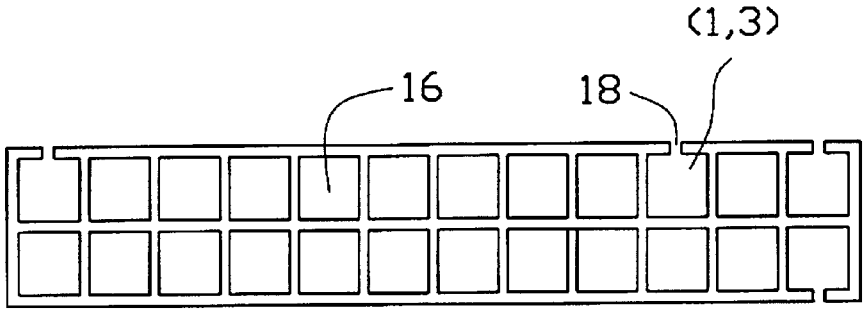
Figure 6:
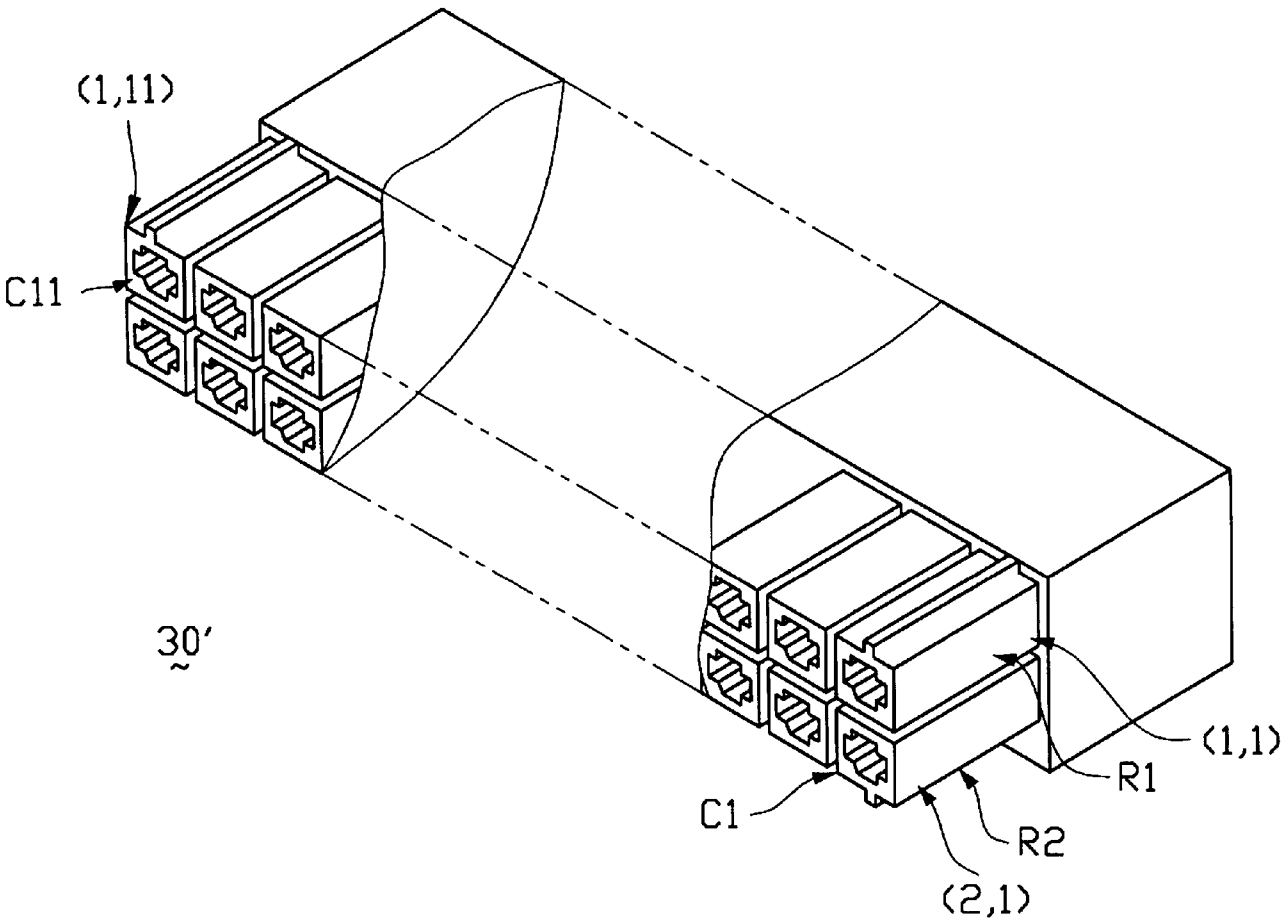
FIG. 6 is a perspective view of another male connector, which has a lesser number of contacts than the female connector of FIG. 1 and is adapted to be mated with the female connector of FIG. 4A

FIG. 3 is a plan view of the female connector 12 of FIG. 1 to show three fixed keyways, positions in the housing 14. Somewhat differently, in FIGS. 4(A)–4(J) each shows a female connector 51 having the basic structure of the female connector 12 of FIGS. 1 and 3 but with an additional keyway 18 adjacent to cavity 16 with identification (1,11) (1,10), (1,9), (1,8), (1,7), (1,6), (1,5), (1,4), (1,3) and (1,2), respectively, in comparison with the female connector 12 in FIGS. 1 and 3. Because the male connectors 30 are generally of two rows and the keys 36 of the male connector 30 are all respectively set on sleeve members 16 labeled as (1,1), (1,12) and (2,1), the female connector 51 with (2×12) matrix arrangement may couple to the male connector 30 with the same (2×12) matrix arrangement. Additionally, by taking advantage of the aforementioned key arrangement of the male connectors 30, the female connector 51 can further couple to another male connector 30' with (2×11) matrix arrangement as shown in FIG. 6 due to the addition keyway 18 adjacent to the cavity 16 labeled (1,11) as shown in FIG 4(A).

Figure 4J:
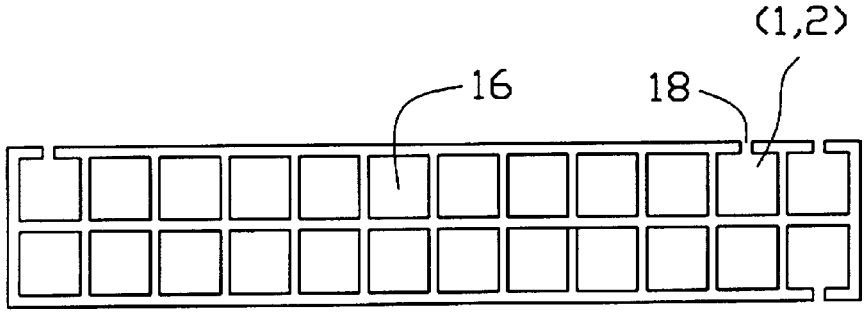

Based on this rule, the female connector 51 may change the additional keyway 18 to other cavities 16 having labels ranged from (1,2) to (1,10) as shown in FIGS. 4(J) back to (B). Under this condition, the possible positions of such additional keyway 18 may be varied from (1,2) to (1,11). Therefore, there are ten variations by following the formula: $N=M-2C_n=(M-2)!/(M-2-n)!n!$ wherein N represents the number of variety for the additional specified connectors, M represents total number of the cavity 16 along one row, C represents factor "Combination" in algebra, and n represents the number of the additional keyways 18. As understood, the symbol $N=M-2C_n$ generally denotes the number of combinations of size n chosen from a set of M−2 elements. Understandably, in the previous condition that other than three fixed keyway 18 disposed adjacent to the cavities labeled (1,1), (1,12) and (2,1), the one additional variable keyway 18 is variably formed in the housing 14 of the female connector 51 within a range adjacent to cavities 16 labeled (1,2) through (1,11), According to the formula, $N=M-2C_n=12-2C_1=10C_1=10$. It means that for the 2×12 female connector, there are ten variations each for additionally coupling to another male connector 30 with a less number of the sleeve members 34 thereof than that of the cavities 16 of the female connector 51, i.e., the male connectors 30 of (2×2, 2×3, . . . , 2×11) matrix. Therefore, FIGS. 4(A)–4(J) show these ten variant female connectors 51 respectively having differently positioned additional keyways 18 adjacent to different cavities 16 labeled from (1,11) to (1,2).

It should be noted that the male connector of (2×1) matrix should in a special form which only receivably complies with the complementary special female connector of the same (2×1) matrix, as disclosed in the previous copending application. It is also seen that as mentioned in the previous copending application, disregarding the engagement between the keyway and the key, only the male connector having a less or equal number of sleeve members relative to that of the cavities of the female connector can possibly mate with the female connector due to the different thicknesses of the partition wall 60 and of the outer wall 62 (FIGS. 1 and 3).

Figure 5A:
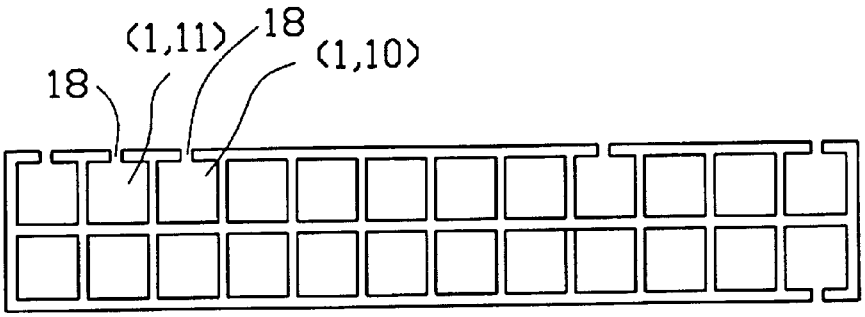
FIGS. 5(A)–5(D) are plan views each generally taken from a cross-section along line L—L of the female connector of FIG. 1 and each having two additional variable keyway between two fixed keyways at two opposite ends to show the different combinations of the mating arrangement.
Figure 5B:
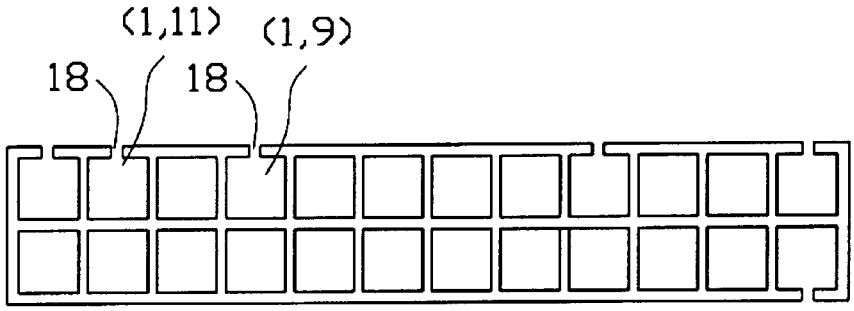
Figure 5C:
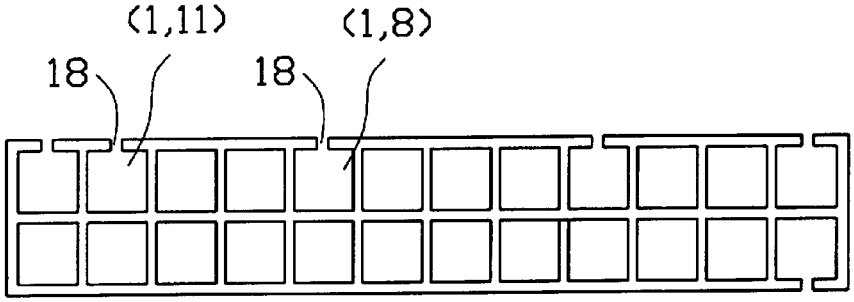
Figure 5D:
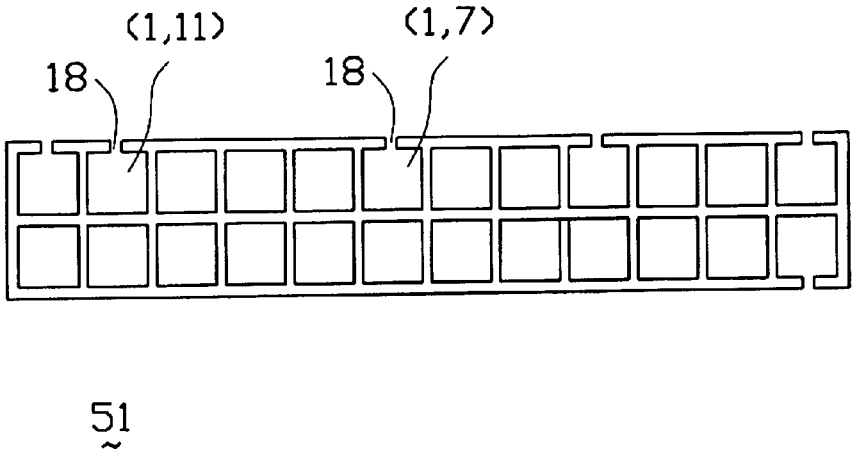

Based on the same formula, when two additional male connectors are desired to mate with the female connector, the (2×12) female connector may have forty-five variations ($N=M-2C_n=12-2C_2=10C_2=10!/(10-2)!2!=45$). FIGS. 5(A)–5(D) only show four of such forty-five variations having additional two keyways 18 adjacent to cavities (1,11) & (1,10) in FIG. 5(A), (1,11) & (1,9) in FIG. 5(B), (1,11) & (1,8) in FIG. 5(C), and (1,11) & (1,7) in FIG. 5(D). Therefore, other than coupling to the (2×12) male connector, the female connector of FIG. 5(A) is adapted to additionally couple to the (2×11) & (2×10) male connectors, the female connector of FIG. 5(B) is adapted to additionally couple to the (2×11) & (2×9) male connectors, the female connector of FIG. 5(C) is adapted to additionally couple to the (2×11) & (2×8) male connectors and the female connector of FIG. 5(D) is adapted to additionally couple to the (2×11) & (2×7) male connectors. Understandably, there are the other forty-one variations (not shown) of the female connector 51 each of which may also couple to two additional male connectors different from those used with the female connectors 51 in FIGS. 5(A)–5(D). It is also noted that the different combinations of the locations of the keyways result in different combinations of the two selected male connectors.

The feature of the invention is to provide at least one additional variable keyway adjacent the cavities between the pair of fixed keyways at two ends of the female connector 12 to form more than one variations to additionally couple to other different male connectors having less numbers of the sleeve members thereof in comparison with the number of the cavities of the female connector. As mentioned before, different from the female connector disclosed in the previous copending application which only mates with the male connector having the same matrix number/manner, the female connector 51 of the invention intentionally adds a third fixed keyway 18 adjacent to the cavity 16 labeled (2,1) to assure all the male connectors can only mate with the corresponding female connector 51 under the condition that the sleeve members 34 of the first column (1,1) & (2,1) are only able to mate with the cavities 16 of the first column (1,1) & (2,1). Without this configuration, there is a possibility that some male connectors each having a less number of the sleeve members 34 than that of the cavities 16, may improperly and incorrectly match the female connector 51 under the condition that the sleeve members 34 of the last column labeled (1,CL) & (2,CL) wherein CL represents the last column, may wrongly couple to the cavities 16 labeled (1,12) & (2,12). Therefore, the third fixed keyway plays an important role in this application. Understandably, the male connector 30 also adds a corresponding key 36 on the sleeve member 34 labeled (2,1) to comply with the added keyway 18 adjacent to the cavity 16 labeled (2,1). The adding of the third keyway 18 in the female connector 51 and of the third key 34 on the male connector 30 regulates the mating of one female connector with more than one male connectors, that is not taught in the previous copending application.

Additionally, the whole mating system is arranged in a systematic, predictable, controllably and scientific manner by following the formula: $N=M-2C_n$ wherein N represents the number of variations, M represents the number of the columns of the cavities of the female connector, C represents factor "Combination" in algebra, and n represents the number of the additional male connectors adapted to mate with one specific female connector. It is also believed that the invention is the first innovative mating system which intentionally allows one female connector to couple to more than one specific designated or selected male connectors in a systematic arrangement.

It is also noted that similar to the copending application, the invention generally focuses on preventing mismatching between the female connector and the male connector with the same row number, i.e., two rows of the sleeve members and of the cavities in this embodiment. It is also noted that the adding of the third keyway in the female connector and the third key on the male connector may also preclude mismatching between two connectors of their different row numbers, while the details regarding preventing mismatching for different row numbers is not intended to thoroughly discussed in this application.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A mating system including:

a female connector comprising a first housing with a plurality of cavities defined by columns and rows in a first matrix arrangement;

a male connector comprising a second housing with a plurality of sleeve members defined by columns and rows in a second matrix arrangement;

a first fixed keyway and a second fixed keyway respectively formed in the first housing communicatively adjacent to the cavities at two opposite ends of the first housing;

a first fixed key and a second fixed key respectively formed on the second housing adjacent to the sleeve members at two opposite ends of the second housing; wherein a third fixed keyway is formed in the first housing communicatively adjacent to one of the cavities located at one of the opposite ends of the first-housing, and a third fixed key is formed on the second housing adjacent to one of the sleeve members at one of the opposite ends of the second housing whereby the male connector can mate with the female connector under a condition that the third key of the male connector is received within the third keyway of the female connector so as to assure that the male connector is only able to couple to the female connector with the first column of the sleeve members being aligned with the first column of the cavities.

2. The system as defined in claim 1, wherein said female connector further includes at least one additional keyway in the housing communicatively adjacent to a cavity between said first and second fixed keyways so that said female connector can couple to at least one additional male connector which has a different matrix arrangement with regard to the female connector.

3. The system as defined in claim 2, wherein said at least one additional keyway is disposed selectably between said first and second fixed keyways by following a formula: $N=_{M-2}C_n$ wherein N represents the number of variations of the locations of the at least one additional keyway, M represents a total number of the columns of the cavities, C represents factor "Combination" in algebra, and n represents the number of the at least one additional keyways.

4. A female connector for use with a mating system, comprising:

a housing defining a plurality of cavities defined by columns and rows in a matrix arrangement;

a pair of fixed keyways respectively formed in the housing communicatively adjacent to two cavities of a-row at two ends of the housing; and a third fixed keyway formed in the housing communicatively adjacent to one of two cavities of another row at the two ends of the housing.

5. The female connector as defined in claim 4, wherein at least one additional keyway is adapted to be selectably formed in the housing between said pair of fixed keyways so as to additionally mate with other male connectors having different matrix arrangements relative to the female connector.

6. A male connector for use with a mating system, comprising:

a housing forming a plurality of sleeve members defined by columns and rows in a matrix arrangement;

a pair of fixed keys respectively formed on two sleeve members of one row at two opposite ends of the housing; and a third key formed on one of two sleeve members of another row at two opposite ends of the housing.

7. A mating system including:

a female connector comprising a first housing with a plurality of cavities defined by columns and rows in a first matrix arrangement;

more than one male connectors each comprising a second housing with a plurality of sleeve members defined by columns and rows in a second matrix arrangement;

a first fixed keyway and a second fixed keyway respectively formed in the first housing communicatively adjacent to two cavities at two opposite ends of the first housing;

a first key and a second key respectively formed on two sleeve members at two opposite ends of the second housing; and at least one additional keyway formed between said first and second fixed keyways so as to selectively couple to at least one additional male connector having a different matrix arrangement relative to the female connector.

8. The mating system as defined in claim 7, wherein said at least one additional keyway is disposed selectably between said first and second fixed keyways by following a formula: $N={}_{M-2}C_n$ wherein N represents the number of variations of the locations of the keyway, M represents a total number of the columns of the cavities, C represents factor "Combinations" in algebra, and n represents the number of the at least one additional keyways.

9. A method for assembling a female connector with more than one selected male connectors, comprising:

providing the female connector with a plurality of cavities in a first matrix arrangement by C1 columns and R1 rows;

providing a first male connector with a plurality of sleeve members in a second matrix arrangement by C2 columns and R2 rows wherein C2 is not larger than C1 and R2 in not larger than R1;

providing a second male connector with a plurality of sleeve members in a third matrix arrangement by C3 columns and R3 rows wherein C3 is not larger than C1 and R3 is not larger than R1;

providing a first fixed keyway and a second fixed keyway communicatively adjacent to two cavities at two opposite ends of the female connector;

providing a first key and a second key on two sleeve members at two opposite ends of the first male connector;

providing a third key and a fourth key on two sleeve members at two opposite ends of the second male connector; and providing at least one additional selected keyway between said first and second fixed keyways in the female connector at a position corresponding to the fourth key of the second male connector; whereby the female connector can couple to the first male connector under a first condition that the first and second keys of the first male connector are respectively received within the corresponding first and second fixed keyways of the female connector; alternatively, the female connector can couple to the second male connector under a second condition that the third and fourth keys of the second male connector are respectively received within the corresponding first fixed keyway and said corresponding additional selected keyway of the female connector.

10. The method as defined in claim 9, wherein said female connector includes more than one additional selectable keyways by following the formula: $N={}_{M-2}C_n$ wherein N represents the number of variations of the locations of the keyway, M represents a total number of the columns of the cavities, C represents factor "Combinations" in algebra, and n represents the number of the at least one additional keyways.

11. The method as defined in claim 10, wherein said female connector can couple to more than two additional male connectors, each of which has a plurality of sleeve members arranged in a number of columns and a number of rows, the number of columns being not larger than C1 and the number of rows being not larger than R1.

12. A mating system including:

a female connector comprising a first housing with a plurality of cavities defined by columns and rows in a first matrix arrangement;

more than one male connectors each comprising a second housing with a plurality of sleeve members defined by columns and rows in a second matrix arrangement;

a first fixed keyway and a second fixed keyway respectively formed in the first housing in alignment with two outermost cavities at two opposite ends of the first housing;, a first key and a second key respectively formed on two sleeve members at two opposite ends of the second housing; and at least one additional keyway formed between said first and second fixed keyways so as to selectively couple to at least one additional male connector having a different matrix arrangement relative to the female connector.

13. A mating system including:

a female connector comprising a first housing with a plurality of cavities defined by columns and rows in a first matrix arrangement, the first housing defining a cross-sectional configuration around each of said cavities, the cross-sectional configurations around two outermost opposite cavities being different from some therebetween;

more than one male connectors each comprising a second housing with a plurality of sleeve members defined by columns and rows in a second matrix arrangement, the second housing defining a cross-sectional contour around each of said sleeve members, the cross-sectional contours around two outermost sleeve members being different from some therebetween; and at least one cross-sectional configuration around a cavity between said two outermost opposite cavities being same with those around said two outermost opposite cavities so as to selectively couple to at least one additional male connector having a different matrix arrangement relative to the female connector.

14. The system as defined in claim 13, wherein the cross-sectional contour around each of said two outermost opposite sleeve members can not receivably comply with the cross-sectional configurations around said some cavities between said two outermost opposite cavities, while the cross-sectional contours around said some sleeve members between the two outermost opposite sleeve members can receivably comply with the cross-sectional configurations around said two outermost opposite cavities without interference.

* * * * *